US008006635B2

(12) United States Patent
Claris

(10) Patent No.: US 8,006,635 B2
(45) Date of Patent: Aug. 30, 2011

(54) ADJUSTABLE WATER FEED DEVICE FOR FEEDING WATER TO A MOISTENER IN A MAIL HANDLING MACHINE

(75) Inventor: Yannick Claris, Fontenay Aux Roses (FR)

(73) Assignee: Neopost Technologies, Bagneux (FR)

( * ) Notice: Subject to any disclaimer, the term of this patent is extended or adjusted under 35 U.S.C. 154(b) by 790 days.

(21) Appl. No.: 11/957,562

(22) Filed: Dec. 17, 2007

(65) Prior Publication Data

US 2008/0156258 A1 Jul. 3, 2008

(30) Foreign Application Priority Data

Dec. 19, 2006 (FR) ..... 06 55640

(51) Int. Cl.
*B05C 11/11* (2006.01)

(52) U.S. Cl. ..... 118/264; 118/267; 118/270; 156/441.5; 156/578

(58) Field of Classification Search ..... 118/264, 118/267, 270; 156/441.5, 578; 427/429; 222/187, 457; 401/196, 198, 199, 123; 141/110, 141/112, 319; 137/453, 454; 119/72, 74, 119/75, 78

See application file for complete search history.

(56) References Cited

U.S. PATENT DOCUMENTS

| | | | | |
|---|---|---|---|---|
| 1,970,460 | A * | 8/1934 | Kirshner | 156/441.5 |
| 2,412,538 | A * | 12/1946 | Commodore | 118/677 |
| 2,418,035 | A * | 3/1947 | Lachapelle | 401/148 |
| 5,354,407 | A | 10/1994 | Hubbard et al. | |
| 5,605,572 | A * | 2/1997 | Berger | 118/241 |

FOREIGN PATENT DOCUMENTS

EP 1640178 A1 3/2006

* cited by examiner

*Primary Examiner* — Laura Edwards
(74) *Attorney, Agent, or Firm* — Sughrue Mion, PLLC

(57) ABSTRACT

A water feed device for feeding water to a moistener for moistening envelope flaps that is incorporated into a mail handling machine, the water feed device comprising a reserve stock of water from which a quantity of water flows to a reservoir of water with which the reserve stock of water is in communication, said quantity of water being suitable for imbibing a piece of foam soaking in said reservoir of water, said reserve stock of water being disposed in a receptacle that is mounted to move vertically between a low position and a high position, which positions correspond respectively to a low water level and to a high water level in said reservoir, it being possible for the receptacle to take up a plurality of other positions between said low and high positions.

5 Claims, 2 Drawing Sheets

ADJUSTABLE WATER FEED DEVICE FOR FEEDING WATER TO A MOISTENER IN A MAIL HANDLING MACHINE

FIELD OF THE INVENTION

The present invention relates exclusively to the field of mail handling, and it relates more particularly to a water feed device for feeding water to a moistener for moistening envelope flaps that is incorporated into a mail handling machine.

PRIOR ART

Devices making it possible to feed water to moisteners in mail handling machines are well known, and conventionally such a device comprises a reserve stock of water mounted on a support and connected to a reservoir of water which is disposed under a conveyor table for conveying the envelopes, and in which a piece of foam soaks. The envelopes are moistened as the flaps of the envelopes pass between the top surface of the moistened piece of foam and a brush placed immediately behind a separator for separating the flaps from the bodies of the envelopes.

Unfortunately, such a water feed device suffers from certain drawbacks. Since such a device does not use any pumping means, it has a single setting that, by definition, cannot be adapted to all of the available types of envelope. Therefore, all of the flaps receive the same quantity of water, thereby degrading the quality of sticking down for certain types of envelope.

OBJECT AND DEFINITION OF THE INVENTION

The present invention thus proposes a water feed device that mitigates those drawbacks and that makes it possible, in particular, to vary the quantity of water deposited on the flaps. An object of the invention is also to allow the user to choose the quantity of water that is best suited to the type of envelopes that the user usually handles. Another object of the invention is to provide such a device without significantly modifying the current structure of mail handling machines.

These objects are achieved by a water feed device for feeding water to a moistener for moistening envelope flaps that is incorporated into a mail handling machine, the water feed device comprising a reserve stock of water from which a quantity of water flows to a reservoir of water with which the reserve stock of water is in communication, said quantity of water being suitable for imbibing a piece of foam soaking in said reservoir of water, wherein said reserve stock of water is disposed in a receptacle that is mounted to move vertically between a low position and a high position, which positions correspond respectively to a low water level and to a high water level in said reservoir.

Thus, with this particular configuration, the quantity of water deposited on the envelope flap can vary as chosen by the user, and can thus be better suited to the various types of envelopes than with prior art devices.

Advantageously, said receptacle can take up a plurality of other positions between said low and high positions.

In a preferred embodiment, said receptacle is moved vertically by turning an adjustment lever that is secured to said receptacle.

Said receptacle may then have a top rim provided with at least one stud serving, when said adjustment lever is turned, to co-operate with a set of teeth on a body portion of the mail handling machine in which the receptacle is mounted.

Said set of teeth is advantageously shaped in a flight-of-steps configuration, each step defining a position in which said lever can be set between said low position and said high position.

Preferably, said reserve stock of water is mounted on a support.

BRIEF DESCRIPTION OF THE DRAWINGS

The characteristics and advantages of the present invention appear more clearly from the following description given by way of non-limiting indication and with reference to the accompanying drawings, in which.

DETAILED DESCRIPTION OF A PREFERRED EMBODIMENT

Figure 1:
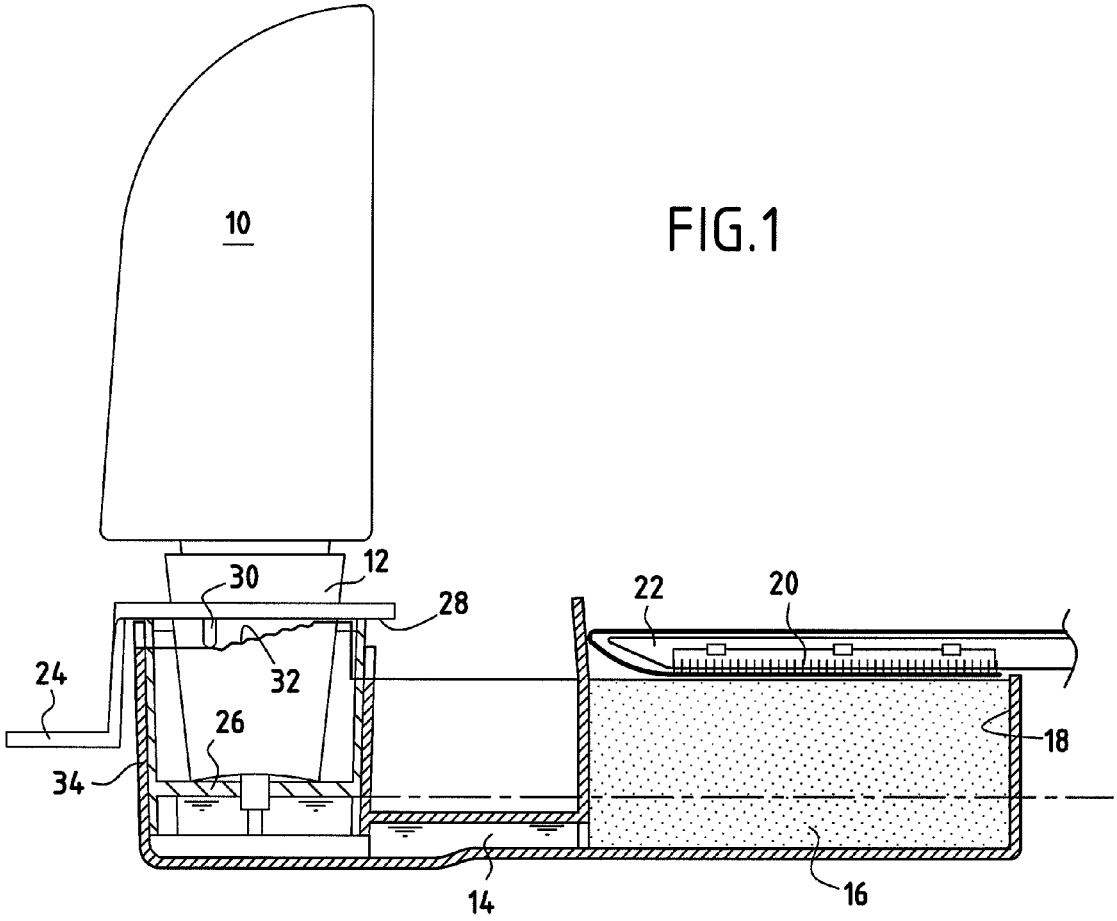
FIGS. 1 and 2 are cross-section views of a water feed device of the invention for a moistener in a mail handling machine, the device being shown in two respective end positions.

A feed device for feeding a moistening liquid to a moistener in a mail handling machine comprises, as is known, a reserve stock of a moistening liquid 10 (preferably water) mounted in a support 12 and from which a quantity of moistening liquid flows through a communication duct 14 for the purpose of imbibing a piece of foam or sponge 16 soaking in a reservoir of liquid 18 disposed under the horizontal plane on which the envelopes are conveyed through the mail handling machine. The envelope flaps are moistened as they pass between the top surface of the foam 16 imbibed with moistening liquid and a hinged brush 20 behind (relative to the direction in which the envelopes advance) a separator 22 designed to separate the flap of each envelope from the body of said envelope. The reserve stock of moistening liquid 10 is easy to remove from its support 12 and can be replaced when the moistening liquid runs short.

Figure 1A:
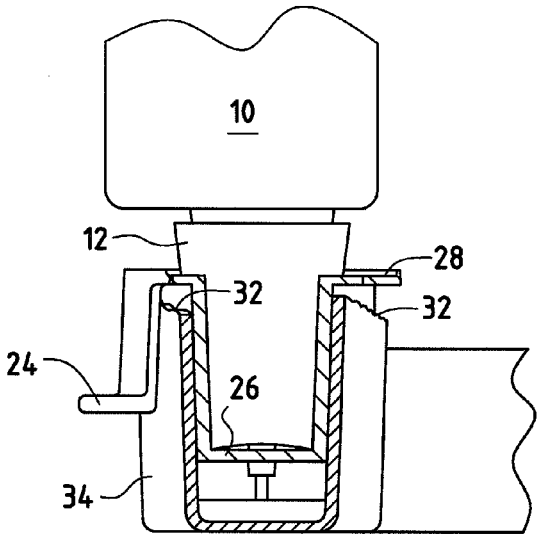
FIGS. 1A and 2A are exploded fragmentary views of the water feed device in the two respective positions shown in FIGS. 1 and 2.
Figure 2:
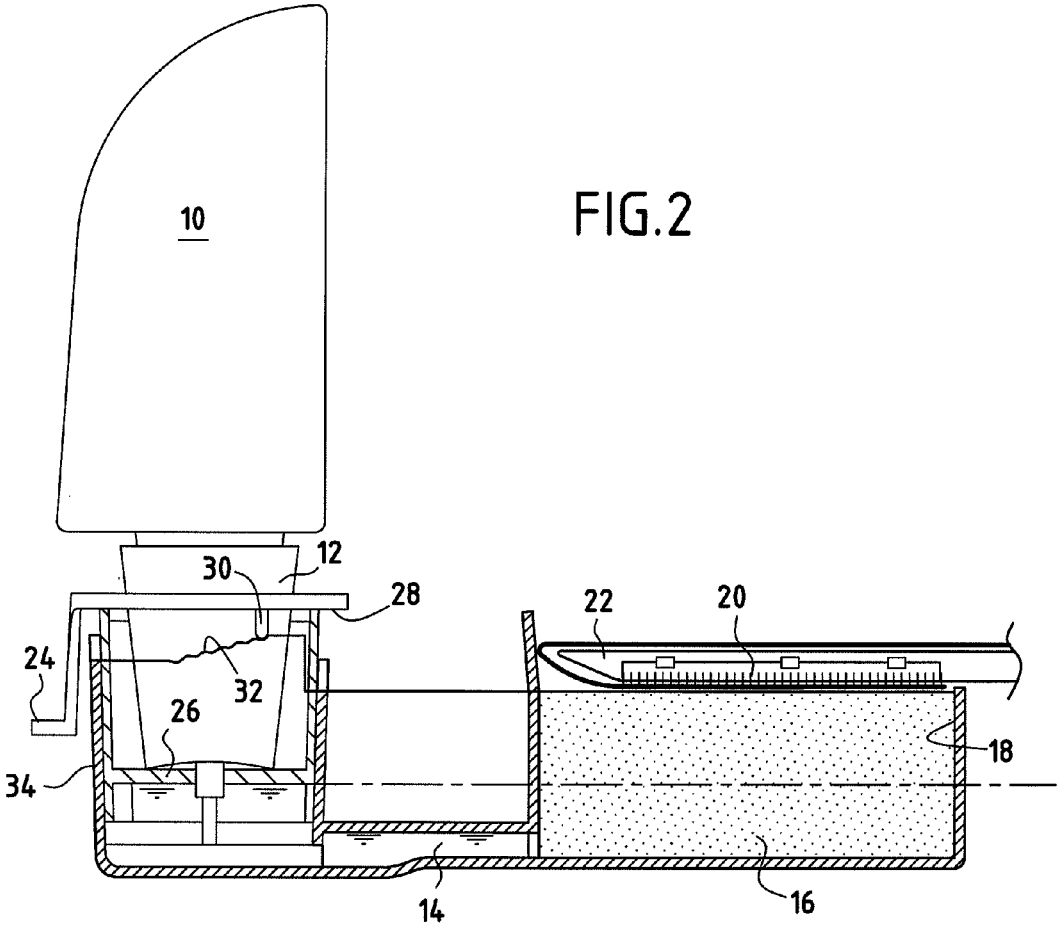
Figure 2A:
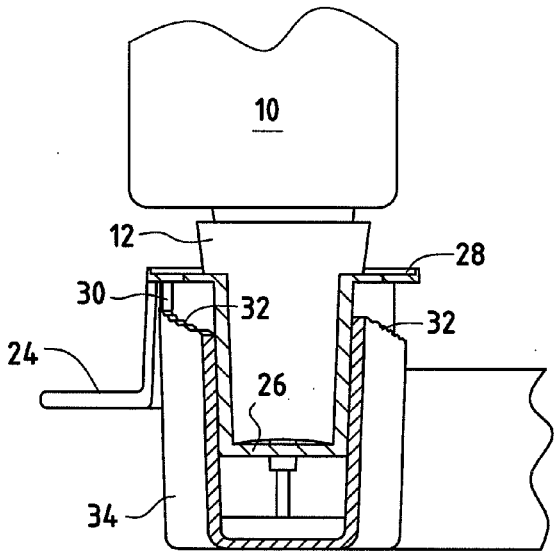

In accordance with the invention, the support of the reserve stock of water can be moved vertically between a low position shown in cross-section in FIG. 1 (and in an exploded view in FIG. 1A) and corresponding to a low first water level and a high position shown in cross-section in FIG. 2 (and in an exploded view in FIG. 2A) and corresponding to a high second water level. This vertical movement is obtained by the user by turning an adjustment lever 24 that is secured to a receptacle 26 that is designed to receive the support for the reserve stock of water (or indeed the reserve stock itself) and that has a top rim 28 provided with at least one stud 30 designed to co-operate with a set of teeth 32 on a body portion 34 of the mail handling machine, in which portion the receptacle is mounted. Said set of teeth is disposed in a flight-of-steps configuration, each step defining a respective one of a plurality of other setting positions between the low position and the high position, and going from one step to the next in the upward direction towards the high position (or going back down to the preceding step in the downward direction towards the low position) being obtained by turning the adjustment lever.

Thus, with this configuration, the quantity of water to be applied to the gummed surface of the flap is adjusted directly by acting on the lever 24. Using the principle of communicating vessels, it is necessary merely to vary the equilibrium height of the reserve stock of water, which height is shown in dashed lines in FIGS. 1 and 2 and corresponds to the lower surface of the reserve stock of water, in order to obtain different heights of water. The water reaches equilibrium in the sponge 16, thereby imbibing said sponge to varying extents, thereby modifying the quantity of water available at the surface of said sponge. Since the brush 20 refills from the surface of the sponge, the quantity of water deposited on the flap is proportional to the moistening of said sponge.

The various positions taken up by the adjustment lever 24 resulting from the stud 30 engaging with particular teeth of the set of teeth 32 make it possible for the user to customize the quantity of water delivered to the brush, an increase in the level of water in the reservoir 18 causing the quantity of water delivered by the brush 20 to the flap to increase immediately.

What is claimed is:

1. A water feed device for feeding water to a moistener for moistening envelope flaps comprising:

a receptacle containing a reserve stock of water;

a reservoir having foam therein;

a conduit connecting the reserve stock of water to the reservoir such that water from the reserve stock of water flows to the reservoir and moistens the foam, wherein said receptacle is vertically moveable between a low position and a high position to respectively alter the level of the water in the reservoir between a low water level and to a high water level to change the degree to which the foam is moistened and wherein said receptacle is moved vertically by turning an adjustment lever that is secured to said receptacle.

2. A water feed device according to claim 1, wherein said receptacle can take up a plurality of other positions between said low and high positions.

3. A water feed device according to claim 1, wherein said receptacle has a top rim provided with at least one stud serving, when said adjustment lever is turned, to cooperate with a set of teeth on a support in which the receptacle is mounted.

4. A water feed device according to claim 3, wherein said set of teeth is shaped in a flight-of-steps configuration, each step defining a position in which said lever can be set between said low position and said high position.

5. A water feed device according to claim 3, wherein said reserve stock of water is mounted on the support.

* * * * *